United States Patent [19]

Smart

[11] 4,337,861

[45] Jul. 6, 1982

[54] BINGO CARD BOX

[76] Inventor: Calvin R. Smart, 160 S. Main St., Franklin, N.H. 03235

[21] Appl. No.: 825,397

[22] Filed: Aug. 17, 1977

Related U.S. Application Data

[63] Continuation-in-part of Ser. No. 775,371, Mar. 7, 1977, abandoned.

[51] Int. Cl.[3] ..... B65D 77/04; B65D 79/00

[52] U.S. Cl. ..... 206/579; 206/45.18; 220/8

[58] Field of Search ..... 206/45, 45.15, 45.16, 206/45.17, 45.18, 45.24, 45.23, 579, 448, 309, 449, 555, 556, 557; 220/8, 23.2, 22.1; 248/444, 447, 450, 461, 462; 211/40, 44, 10, 11; 273/135 B, 135 BC, 136 D, 136 G, 136 K, 148 A; 312/13, 14, 30, 308, 321

[56] References Cited

U.S. PATENT DOCUMENTS

| | | | |
|---|---|---|---|
| 1,494,600 | 5/1924 | Gideon et al. | 206/45.18 |
| 2,223,074 | 11/1940 | Martin | 220/8 |
| 2,369,728 | 2/1945 | Farkas | 220/8 |
| 3,003,840 | 10/1961 | Katzin | 312/298 |
| 3,140,777 | 7/1964 | Gordan | 220/8 |
| 3,232,439 | 2/1966 | Dahl, Jr. | 220/8 |
| 3,463,343 | 8/1969 | Asenbauer | 220/8 |
| 3,889,808 | 6/1975 | Helms | 206/45.18 |

FOREIGN PATENT DOCUMENTS

| | | | |
|---|---|---|---|
| 1081054 | 12/1954 | France | 206/45.24 |

*Primary Examiner*—Herbert F. Ross

*Attorney, Agent, or Firm*—Strimbeck, Davis & Soloway

[57] ABSTRACT

An adjustable card box to hold a multiplicity of the slide-type bingo cards in an upright viewing position and in a manner such that they can be rapidly flipped through comprises two trays, one of which fits and telescopes within the other. A finger-operable locking means serves to lock the position of one tray with respect to the other to permit expanding and collapsing of the space encompassed by the trays to facilitate storage of the box and to permit a player to accommodate the number of cards he wishes to play. The card box has front and rear upward extending flaps pivotedly mounted to the sidewalls, which in the open position serve to support the cards in the viewing position. The flaps can be folded down into the box flat to permit storage of the box and carrying of a vertical stack of playing cards on the box.

4 Claims, 2 Drawing Figures

BINGO CARD BOX

RELATED APPLICATION

This application is a continuation-in-part of "Adjust-A-Bingo-Box," Ser. No. 775,371, filed Mar. 7, 1977, now abandoned.

INTRODUCTION

Bingo is played widely and extensively throughout the country. The traditional bean card, which must be played flat on the table, is giving way to the slide types of cards which can be held and viewed more or less vertically. For example, see the "PLA-MOR" card by Bingo King of Englewood, Colo., having a face size of about $7\frac{1}{2}'' \times 8\frac{1}{4}''$ and a thickness of about 3/16". These new types of cards permit a player to handle and play many, many cards at one time, in some cases as many as 30 or 40. There has been a desideratum for a holder to conveniently hold for display and rapid flip-through by a player a large number of slide-type cards. The weight and volume of 30 to 40 of these cards is considerable and any holder thereof must be of substantial construction.

THIS INVENTION

This invention is a bingo card box for the heavy, slide-type cards. The present card box is characterized by:

(1) having a telescoping or collapsing arrangement of one tray within another so that the box can be stored in the collapsed position and can be expanded for use to accommodate any number of cards desired to be played by the player;

(2) having a positive manual locking of the position of one tray with respect to the other;

(3) using flip-up front and rear flaps to confine and support the cards in a generally upright viewing position with the flaps being foldable into the trays to facilitate storage of the box;

(4) being constructed sturdily of wood or plastic with the sidewalls of the trays preferably engaging in a tongue and groove arrangement to help assure a smooth telescoping action;

(5) having, in a preferred embodiment, the size of the box opening in the collapsed position such as to accommodate one of the playing cards laying flat to permit as stack of them to be carried by the player flat on top of the box to his playing table.

THE DRAWINGS

In the drawings

DESCRIPTION

Figure 1:
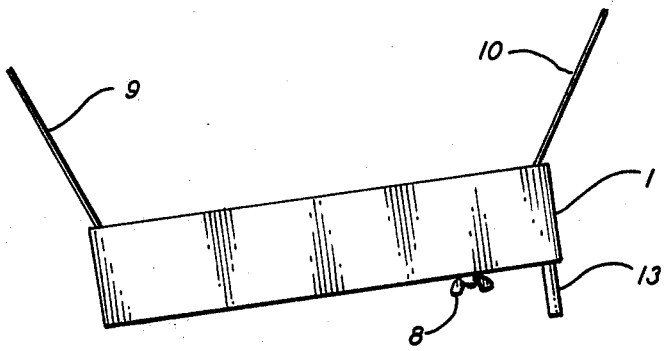
FIG. 1 is a side elevational view of the bingo card box of this invention showing the two trays in the collapsed position.
Figure 2:
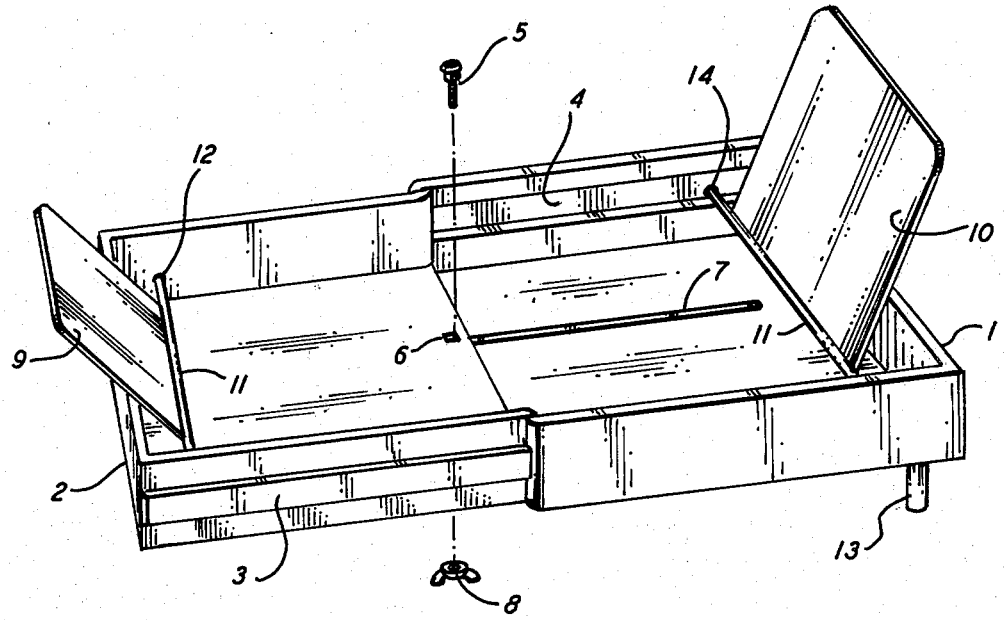
FIG. 2 is a perspective view of the tray in its expanded position.

With reference to the drawings there is illustrated a bingo card box to hold from approximately 1 to 40 windowed, slide-type bingo cards in an upright viewing position such that they can be rapidly flipped through during play. The box can, for example, in the collapsed position have inside dimensions of about $8\frac{1}{2}''$ long, $7\frac{5}{8}''$ wide, and $1\frac{1}{2}''$ deep. When fully extended, it can be 14".

A larger outside box 1 receives and holds an inner box 2 designed to telescope or slide in and out of box 1 on tongue and groove runners, 3 being the tongue and 4 being the groove. In order to lock the trays in whatever position is desired, a small bolt 5 fits into a hole 6 in the bottom of tray 2 and extends through a slot 7 in the bottom of tray 1 to engage on the underneath side a wing nut 8. The wing nut can be tightened and loosened by hand to allow the trays to telescope.

A front flap 9 is pivotedly mounted between the sidewalls of trays 2 on a small rod 11, which rod is mounted in holes 12 on the inside edge of the box. Similarly, a rear flap 10 mounted on a rod 11 is positioned between the sidewalls of tray 1 in holes 14. Flaps 9 and 10 can be folded flat within the interior of the trays when not in use. The end walls of trays 1 and 2 do not have a height sufficient to support the cards in play and it is for this reason that flaps 9 and 10 are used. As can be seen, flaps 9 and 10 are supported in the upright position by resting against the end walls of their respective trays.

Two legs 13 at either rear corner cant the box forward towards the user for better viewing of the cards. These legs are, preferably, removably pegged into the bottom of the box so that they can be removed for shipment and storage of the box.

What is claimed is:

1. A card box adapted to hold a multiplicity of slide-type bingo cards comprising: two trays, an inner one nestling and telescoping within an outer one, said trays each having two sidewalls and an end wall that is on the opposite end from the end wall of the other tray, said end walls being of a height insufficient to support said slide-type bingo cards in a generally upright viewing position; finger-operable locking means adapted to lock the position of one tray with respect to the other and to permit the expanding and collapsing of the space encompassed by said trays as desired by the user thereof; and front and rear flaps pivotedly mounted between and to the sidewalls of said trays and extending upwardly in the open position to support said slide-type bingo cards in said generally upright viewing position, said flaps being supported in said open position by the respective said end wall adjacent thereto and being adapted to being folded down one over the other into said space encompassed by said trays and onto the bottom interior surface of said box when said trays are in a collapsed position, thus facilitating storage of said card box, said space encompassed by said trays when in a collapsed position being approximately the size of the face of one of said bingo cards such that a multiplicity of said bingo cards can lay flat therein on top of said flaps when said card box is collapsed for storage.

2. The card box of claim 1 wherein said finger-operable locking means comprises a slot in a front to rear direction in the floor of one of said trays and a clamp extending therethrough from the other of said trays and being finger-operable from the underneath side of said card box.

3. The card box of claim 2 wherein said clamp is a bolt and a wing nut.

4. The card box of claim 1 having in addition rear legs adapted to tilt the box towards the viewer.

* * * * *